US007971533B1

(12) United States Patent
Berlin et al.

(10) Patent No.: US 7,971,533 B1
(45) Date of Patent: Jul. 5, 2011

(54) METHODS AND APPARATUS FOR WEAPON FUZE

(75) Inventors: Bryan Berlin, Tucson, AZ (US); Bradley Biggs, Corona, AZ (US); Travis Walter, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 579 days.

(21) Appl. No.: 12/013,155

(22) Filed: Jan. 11, 2008

Related U.S. Application Data

(60) Provisional application No. 60/884,826, filed on Jan. 12, 2007.

(51) Int. Cl.
*C06C 5/04* (2006.01)

(52) U.S. Cl. ..... 102/275.9; 102/275.12; 102/206

(58) Field of Classification Search ..... 102/211, 102/212, 213, 214, 215, 216, 217, 218, 219, 102/220, 265–275, 275.9, 275.12, 206
See application file for complete search history.

(56) References Cited

U.S. PATENT DOCUMENTS

| | | | | |
|---|---|---|---|---|
| 2,960,036 | A | 11/1960 | Curl et al. | |
| 4,421,030 | A | 12/1983 | Dekoker | |
| 5,325,784 | A * | 7/1994 | Bai et al. | 102/293 |
| 5,939,662 | A | 8/1999 | Bootes et al. | |
| 6,523,477 | B1 * | 2/2003 | Brooks et al. | 102/481 |
| 6,978,967 | B1 | 12/2005 | Scheper et al. | |
| 7,213,518 | B2 * | 5/2007 | Sutcliffe | 102/215 |
| 7,549,374 | B2 * | 6/2009 | Schwantes et al. | 102/275.9 |
| 7,552,682 | B2 * | 6/2009 | Schwantes et al. | 102/275.9 |
| 2004/0163564 | A1 * | 8/2004 | Sutcliffe | 102/266 |
| 2004/0200375 | A1 | 10/2004 | Kautzsch et al. | |
| 2008/0148984 | A1 * | 6/2008 | Schwantes et al. | 102/215 |
| 2009/0211481 | A1 * | 8/2009 | Schwantes et al. | 102/275.12 |
| 2010/0005995 | A1 * | 1/2010 | Sutcliffe | 102/265 |

* cited by examiner

*Primary Examiner* — Benjamin P Lee
(74) *Attorney, Agent, or Firm* — Ingrassia Fisher & Lorenz, P.C.

(57) ABSTRACT

Methods and apparatus for a weapon according to various aspects of the present invention comprise and/or operate in conjunction with a warhead case and a fuze system. The fuze system may comprise a fuze housing including a flange configured to be secured to the weapon. In one embodiment, the methods and apparatus operate in conjunction with a fuze well rigidly attached to the warhead case. In addition, the methods and apparatus may include a sensor mounted on the flange, and a booster attached to the fuze well adjacent the fuze housing.

20 Claims, 5 Drawing Sheets

METHODS AND APPARATUS FOR WEAPON FUZE

CROSS-REFERENCE TO RELATED APPLICATION

This application claims the benefit of U.S. Provisional Patent Application No. 60/884,826, filed Jan. 12, 2007.

GOVERNMENT RIGHTS

The Government of the United States of America has certain rights in this invention.

BACKGROUND

Fuze systems, such as those used to initiate detonation of warheads in artillery shells, bombs, missiles, projectiles, or the like, must satisfy high performance criteria. In many applications, the fuze systems use electronic components to continuously monitor the projectile's environment and initiate detonation of the warhead at a specific moment—often requiring accuracy of milliseconds or better. These fuze systems typically use one or more timers, accelerometers, gyroscopic systems, optical sensors, mechanical sensors, radar systems, acoustic sensors, magnetic sensors, etc. to determine optimum detonation time.

The fuze systems may be used by many different weapons systems, such as bombs and missiles for attacking hardened or buried targets. These penetrating weapons systems may penetrate concrete or reinforced concrete surrounding hardened targets before detonating. Or, in the case of buried targets, the weapons systems may penetrate the ground above or near a target before detonating. Penetration allows weapon detonation closer to the target than a surface strike, delivering more explosive force to the target.

The fuze systems of such ground penetrating weapons systems should accurately detect various signals or stimuli as the weapon system attacks a target. For example, some fuze systems may detect the number of floors that the weapon has passed through, allowing a particular level of a structure to be attacked. The sensors and associated fuze system components should withstand the violent shocks and vibrations that occur during target penetration. If vibrations within the weapons system are communicated to the sensors in the fuze system, the sensors may generate false readings or possibly be damaged. This may result in incorrect sensor readings and a fuze system that detonates the warhead at the wrong time and location or that fails to detonate the warhead.

SUMMARY OF THE INVENTION

Methods and apparatus for a weapon according to various aspects of the present invention comprise and/or operate in conjunction with a warhead case and a fuze system. The fuze system may comprise a fuze housing including a flange configured to be secured to the weapon. In one embodiment, the methods and apparatus operate in conjunction with a fuze well rigidly attached to the warhead case. In addition, the methods and apparatus may include a sensor mounted on the flange, and a booster attached to the fuze well adjacent the fuze housing.

BRIEF DESCRIPTION OF THE DRAWINGS

Representative elements, operational features, applications, and/or advantages of the present invention reside in the details of construction and operation as more depicted, described and claimed. Reference is made to the accompanying drawings, wherein like numerals typically refer to like parts.

Elements in the figures are illustrated for simplicity and clarity and have not necessarily been drawn to scale. For example, the dimensions of some of the elements in the figures may be exaggerated relative to other elements to help improve understanding of various embodiments of the present invention. Furthermore, the terms "first", "second", and the like, if any, are used for distinguishing between similar elements and not necessarily for describing a priority or a sequential or chronological order. Moreover, the terms "front", "back", "top", "bottom", "over". "under", and the like in the description and/or in the claims, if any, are generally employed for descriptive purposes and not necessarily for comprehensively describing exclusive relative position. Any of the preceding terms so used may be interchanged under appropriate circumstances such that various embodiments of the invention may be rendered capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventor's conception of the best mode, and are not intended to limit the applicability or configuration of the invention in any way. Rather, the following description is intended to provide convenient illustrations for implementing various embodiments of the invention. Changes may be made in the function and/or arrangement of any of the elements described in the disclosed exemplary embodiments without departing from the spirit and scope of the invention.

For example, various representative implementations of the present invention may be applied to any number of weapons and fuze systems. A detailed description of exemplary applications, namely methods and apparatus for implementing fuze systems for weapons, is provided as a specific enabling disclosure that may be generalized to any application of the disclosed systems, devices, and methods for weapons and fuze systems in accordance with various embodiments of the present invention.

Figure 1:
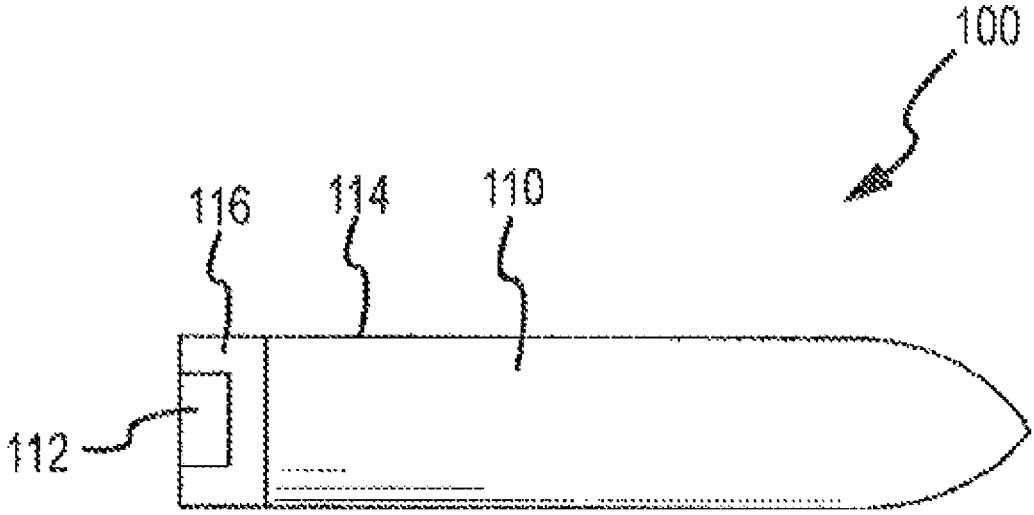
FIG. 1 illustrates a weapon according to various aspects of the present invention.
Figure 2:
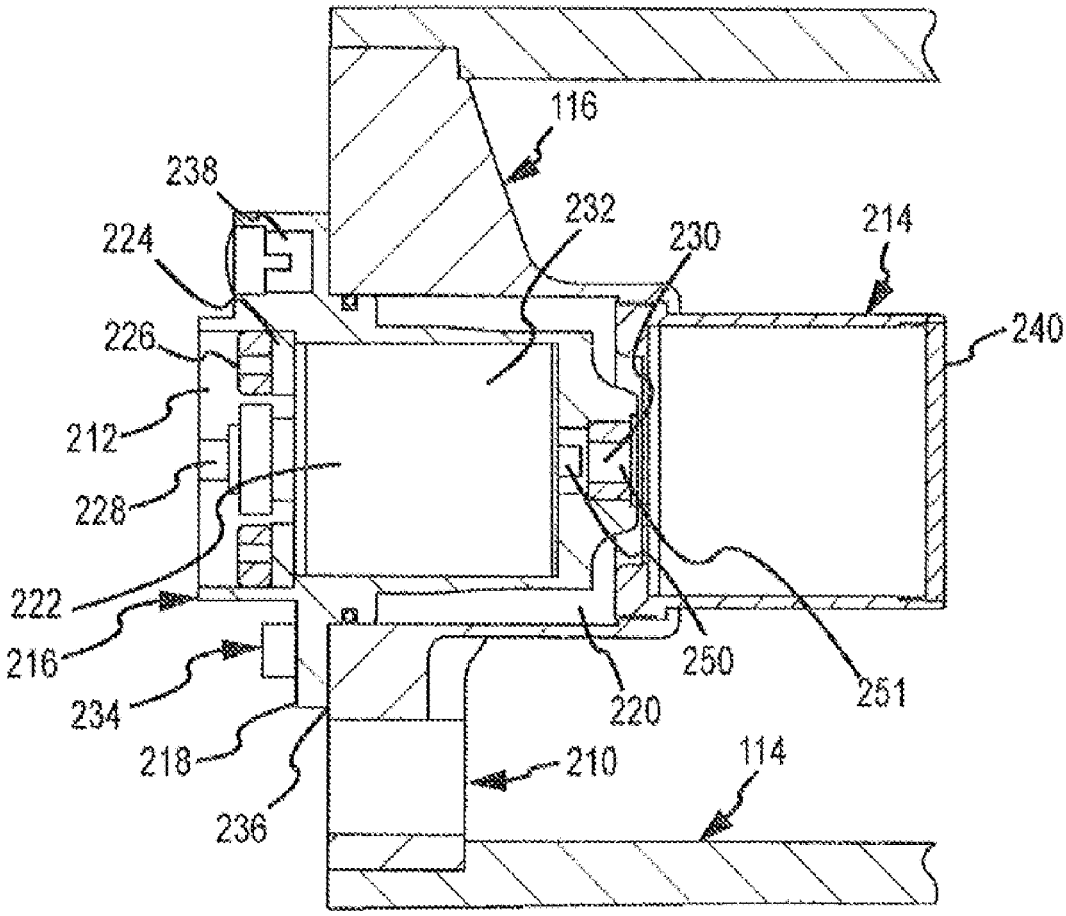
FIG. 2 illustrates a cross-section of a warhead case, a fuze well, and a fuze system.
Figure 3A:
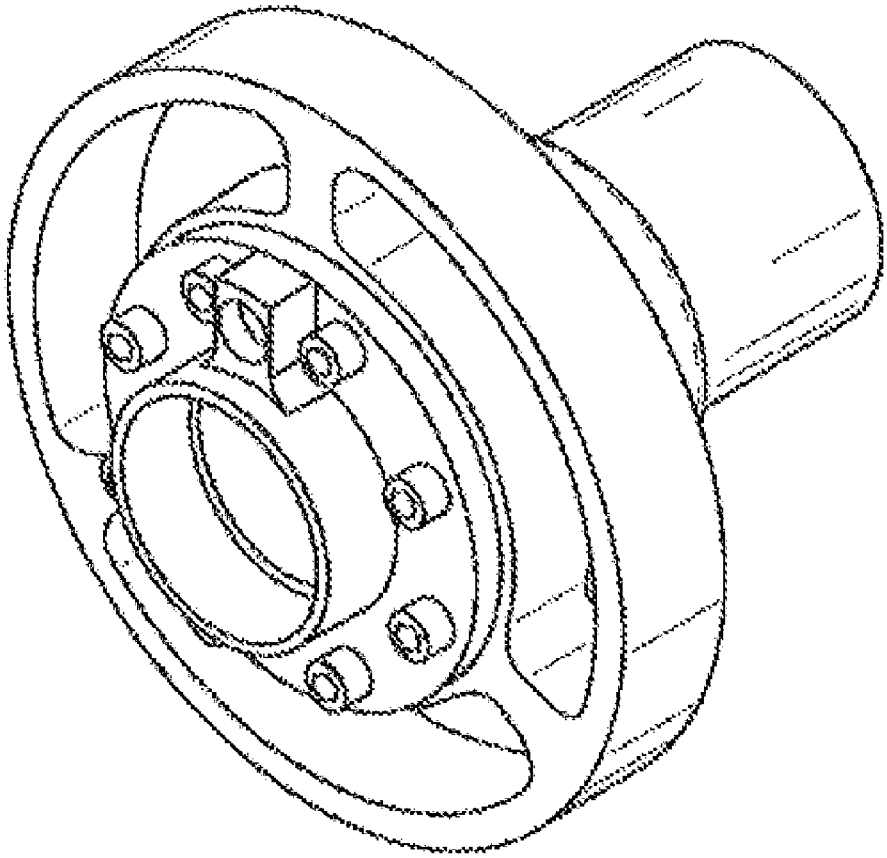
FIGS. 3A-D are, respectively, a perspective view, a side view, a front view, and a cross-section view of a fuze system.
Figure 3D:
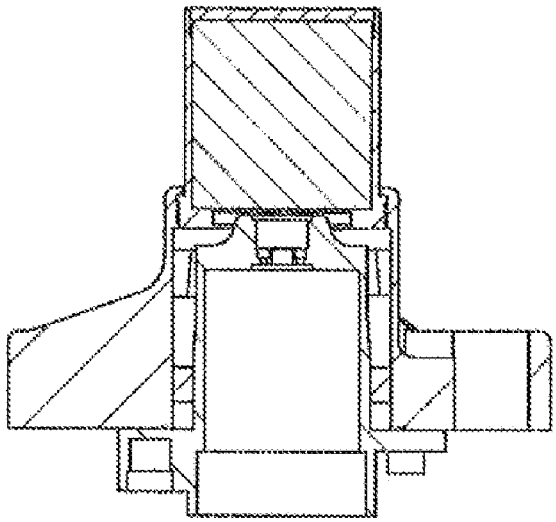
Figure 3C:
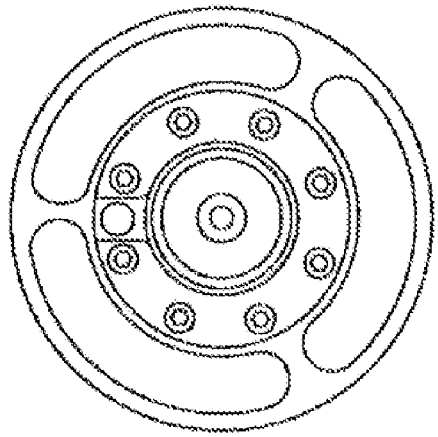
Figure 3B:
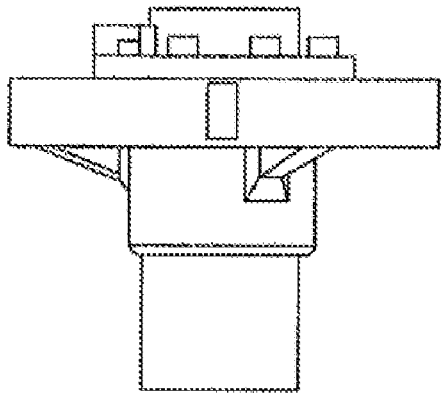

Referring to FIGS. 1 and 2, a weapon 100 according to various aspects of the present invention comprises a warhead 110 and a fuze system 112. The fuze system 112 may be mounted on any appropriate weapon 100, such as a missile or bomb, to initiate detonation of the weapon 100. The fuze system 112 may be coupled to the warhead 110, such as to a warhead case 114 and/or a fuze well 116, and may comprise components configured to detonate the warhead 110 at an appropriate time or under appropriate circumstances.

For example, the fuze system 112 may be connected to the warhead case 114 and/or fuze well 116, which may contain at least a portion of the fuze system 112. The warhead 110 may comprise any appropriate weapon 100, such as a conventional bomb or missile, and the warhead case 114 may comprise the case or other structure associated with the weapon 100. In the present embodiment, the warhead 110 comprises a penetrating weapon, such as a ground-penetrating bomb or a propelled structure-penetrating missile. The warhead case 114 may be the skin of the weapon 100 or other suitable structure. The warhead case 114 may also contain other elements of the weapon 100, such as a payload, guidance systems, and propulsion systems.

The fuze well 116 receives the fuze system 112 to arm the weapon 100. The fuze well 116 may be coupled to or integrated into the warhead case 114. The fuze well 116 may comprise any suitable fuze well 116, such as a conventional fuze well. In the present embodiment, the fuze well 116 includes connectors, such as threaded surfaces, to engage the fuze system 112 and/or other components, such as a fuze booster. In the present embodiment, the fuze well 116 is welded to the warhead case 114. Alternatively, the fuze well 116 may be otherwise attached to the warhead 110, such as bolted to the warhead case 114, integrally formed into the warhead case 114, or screwed into the warhead case 114.

Referring to FIGS. 2 and 3A-D, the fuze well 116 may include one or more fuze well vents 210. The fuze well vents 210 may comprise any suitable stricture for providing access to an interior portion of the warhead case 114 or venting vapors from an interior portion of the warhead case 114. The fuze well vents 210 may comprise openings defined through the fuze well 116, and may be any appropriate size and arrangement. The fuze well vents 210 may allow vapors to vent from an interior portion of the warhead case 114. For example, if the warhead 110 materials generate vapors, for example due to heat, the vapors may escape via the fuze well vents 210, potentially avoiding inadvertent detonation. The fuze well vents 210 also provide access to the interior of the warhead case 114 to permit the fuze well 116 to be welded or otherwise affixed to the warhead case 114, which eliminates the typical threaded or other mechanical joint and more closely couples the warhead 110 to the fuze 212. Elimination of mechanical joints tends to reduce noise and/or amplification of high frequency levels.

The fuze system 112 initiates detonation of the warhead 110. The fuze system 112 of the present embodiment is configured to be mounted on the fuze well 116 to facilitate detonation of the weapon 100. The fuze system 112 may comprise any appropriate components and systems, such as control elements, pyrotechnic elements, connectors, and sensors. In the present embodiment, the fuze system 112 comprises a fuze 212 and a booster 214. The fuze 212 initiates the detonation in response to a signal or other criteria. The fuze 212 activates the booster 214, which then detonates the main explosive in the warhead 110. Thus, when the fuze system 112 is properly mounted on the fuze well 116, the fuze system 112 may be activated to detonate or otherwise activate the warhead 110.

The fuze 212 initiates the detonation process in response to a selected event, signal, stimulus, condition, or other triggering phenomenon. For example, the fuze 212 may initiate the detonation in response to the fuze detecting impact, the fuze timing out after a delay after detecting an impact, the fuze sensing depth of burial from impact and detecting the programmed depth of burial distance, the fuze detecting a preprogrammed layer or void after impact, a series of detected impacts, a remote signal, or the like. In the present embodiment, the fuze 212 detonates in response to detection of a programmed event, such as penetrating one or more floors or layers of structure. The fuze 212 may comprise any appropriate components and materials for initiating the detonation according to the desired criteria, such as sensors, housings, receivers, transmitters, explosives, and fasteners. In the present embodiment, the fuze 212 comprises a housing 216 and a fuze connector 218. The fuze connector 218 supports the housing 216 within the fuze well 116, and the housing 216 contains elements of the fuze 212.

The housing 216 contains various elements of the fuze 212. The housing 216 may comprise any appropriate housing, such as a rigid casing. In the present embodiment, the housing 216 comprises a hollow member 220 comprising a hard material, such as hardened steel, defining an interior cavity 222. The housing 216 may also define an open end of the interior cavity 222, which may be fitted with an end cap 224 to form an enclosure. The end cap 224 may likewise comprise a hard material, such as the same material as the housing 216, though the end cap 224 and the housing 216 may comprise any appropriate materials. The end cap 224 and housing 216 may further include other elements as may be appropriate, such as a lock ring 226 or other mechanism to secure the end cap 224 to the housing 216 and an electrical connector 228 to facilitate powering, programming, and monitoring the fuze 212 components.

The housing 216 may contain any appropriate elements of the fuze 212. In the present embodiment, the interior cavity 222 of the fuze 212 contains a detonating element 230 and a control system 232. The detonating element 230 causes the booster 214 to detonate, and may comprise any suitable detonating element, such as one or more of a conventional detonator, an exploding foil initiator, an electric exploding device, a lead charge, a laser, a pyrotechnic device, a shock generator, or other appropriate element for detonating the booster 214. In the present embodiment, the detonating element 230 comprises an exploding foil initiator 250 and a lead charge 251 configured to detonate the booster 214 in response to a signal from the control system 232.

The control system 232 controls the detonation process of the weapon 100. The control system 232 may also control any other functions of the weapon 100, such as communications, navigation, guidance, targeting, or other functions. The control system 232 may also comprise any appropriate systems for performing the control functions, such as a conventional electronic control system comprising a processor and a memory. In the present embodiment, the control system 232 comprises a programmable electronic controller that can be programmed to detonate the detonating element 230 upon detection one or more conditions, such as upon detecting penetration of the weapon 100 through a selected number of levels of a building or bunker. The control system 232 may also be supported within the interior cavity 222 by any appropriate materials or system, such as a potting material configured to minimize vibrations transmitted to the control system 232. The weapon 100 navigation may be external to the fuze 212.

The fuze system 112 is connected to the weapon 100. The fuze system 112 may be connected to the weapon 100 in any appropriate manner, such as via a permanent, attachable, and/or removable connection, and using any appropriate connection mechanism. In the present embodiment, the fuze system 112 is removably mounted in the fuze well 116 via the fuze connector 218 and one or more fasteners 234. The fuze connector 218 is attached to or is a part of the fuze housing 216, and the fasteners 234 attach the fuze connector 218 to the fuze well 116, thus fastening the fuze housing 216 to the fuze well 116.

The fuze connector 218 facilitates fastening to the fuze system 112 to the weapon 100, and may comprise any appropriate structure or component. For example, the present fuze connector 218 may comprise a rigid structure connected to another part of the fuze system 112, such as a flange 236 connected to the fuze housing 216. The fuze connector 218 may be permanently or removably attached to the fuze housing 216, for example via welding, molding, friction fit, threaded surfaces, or fasteners.

The fuze connector 218 may also be removably or permanently connected to the fuze well 116 or other part of the weapon 100. For example, the fuze connector 218 may have one or more apertures to receive the fastener 234 connected to the weapon 100, such as a bolt or other fastener connected to the fuze well 116. The fuze well 116 may likewise be equipped to engage the fuze connector 218 or a fastener 234, such as including threaded cavities to engage threaded bolts received through the fuze connector 218.

In the present embodiment, the flange 236 is integrated into the fuze housing 216 to form a single unit, for example via molding or machining. Alternatively, the flange 236 may be welded, bolted, or otherwise mechanically coupled to the fuze housing 216. The fuze housing flange 236 may also couple to the fuze housing 216 via a threaded connection, such as a threaded interior surface of the fuze housing flange 236 and configured to couple to a threaded outer surface of the fuze housing 216.

The flange 236 may provide a connection point for connecting the fuze housing 216 to the fuze well 116. In the present embodiment, the flange 236 comprises multiple apertures, such as three to eight apertures, to receive bolts or other fasteners 234. The fasteners 234 may couple to corresponding threaded cavities defined in the fuze well 116, to nuts on the opposite side of the fuze well 116, or the like. Alternatively, the fasteners 234 may be integrated into the fuze well 116, for example by molding or machining, or otherwise attached to the fuze well 116 or other appropriate structure, such as by welding, friction fit, brazing, or adhesive.

In the present embodiment, the fasteners 234 comprise conventional bolts that pass through the apertures in the flange 236 and engage threaded holes formed in the fuze well 116 to attach the fuze housing 216 to the fuze well 116. Attaching the fuze 212 to the fuze well 116 using multiple fasteners 234 and multiple points around the longitudinal axis of the weapon 100, such as by bolting the flange 236 to the fuze well 116 at multiple points around the longitudinal axis for installing the fuze housing 216, allows a high preload to be applied to secure the fuze 212 in position, which tends to reduce vibrations and movement of the fuze 212 relative to the fuze well 116 and other elements of the weapon 100. Using the multiple, evenly-spaced fasteners 234 further ensures the preload is uniform around the fuze housing 216.

Figure 4:
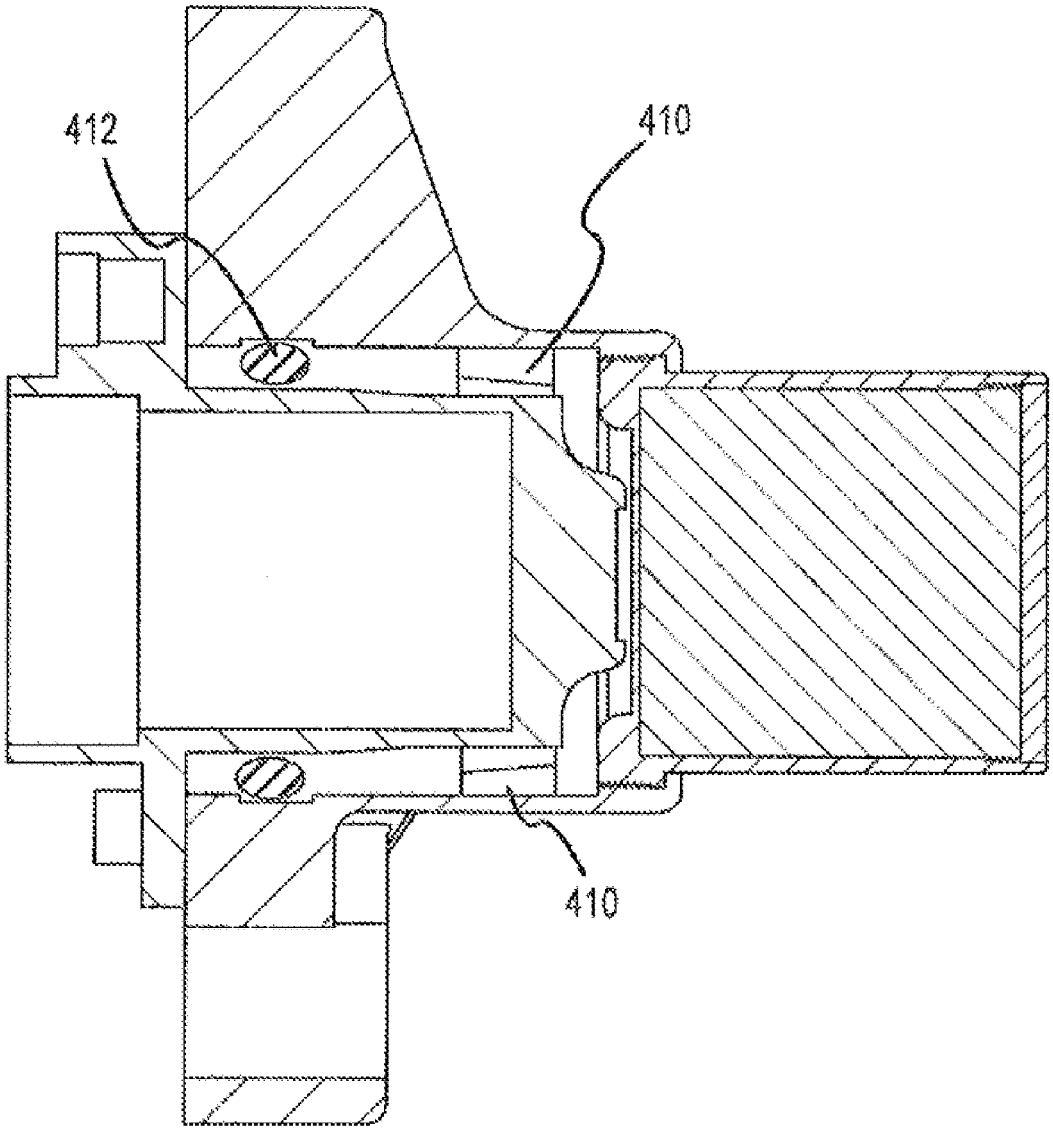
FIG. 4 is a cross-section of an alternative fuze well and a fuze system.

The fuze housing 216 may be further configured in any appropriate manner to be secured to the fuze well 116 and operate properly. For example, the fuze housing 216 may be shaped to be received within the fuze well 116 and to minimize transmission of vibrations within the fuze well 116. For example, referring to FIG. 4, the fuze housing 216 and fuze well 116 may further comprise one or more tapered structures and or anti-vibration mounts to minimize lateral movement of the fuze housing 216 with respect to the fuze well 116 when the fuze housing 216 is coupled to the fuze well 116. The structures may comprise any suitable structure for minimizing movement. The structure may be selected according to the configuration and application of the system, and the tapering or other structures may run along the entire length of the fuze housing 216 and fuze well 116, or may be relatively short and only comprise a fraction of the length of either the fuze housing 216 or fuse well 116.

In the present embodiment, the diameter of the fuze housing 216 decreases as it extends away from the flange 236. The tapered structure is configured to engage one or more antivibration mounts 410 when the fuze housing 216 is secured within the fuze well 116, such that the tapered fuze housing 216 exterior abuts the anti-vibration mounts 410 and/or a tapered fuze well 116 interior to create a stable interface between the fuze housing 216 and the fuze well 116.

The fuze housing 216 and/or the fuze well 116 may also include one or more seals and/or vibration control mechanisms. For example, the fuze housing 216 and/or the fuze well 116 may include one or more circumferential grooves to receive one or more resilient O-rings 412. The O-rings 412 inhibit transmission of vapors and/or moisture between the exterior of the weapon 100 and the booster explosive, munition explosive, or other materials that may render the booster or other weapon components unsafe or unreliable to detonate. The O-rings 412 may also or alternatively be configured to mitigate the transmission of vibrations between components of the fuze system 112.

The fuze system 112 may further comprise a sensor 238. The sensor 238 may comprise any appropriate sensor for a particular application or mission, such as a laser targeting sensor, a positioning sensor, inertial guidance sensors, gyroscopic sensors, or the like. In the present embodiment, the sensor 238 comprises a target discrimination sensor, such as an electro-mechanical accelerometer configured to detect incremental decelerations as the weapon 100 passes through multiple levels of a building or bunker. The sensor 238 is connected to the control system 232 to provide signals to the control system 232.

The sensor 238 may be mounted on the fuze system 112. The sensor 238 may be mounted at a location on the weapon 100 to reduce exposure to vibrations that might affect the operation of the sensor 238. In one embodiment, the sensor 238 is mounted at a location separated from the warhead 110, the control system 232, or other relevant components by as few mechanical interfaces and joints as is practical. By reducing the number of joints and mechanical interfaces affecting the sensor 238, vibrations and noise associated with such joints and interfaces may be reduced.

In the present embodiment, the sensor 238 may be mounted in a cavity defined in the flange 236, such as opposite the fuze well 116 or adjacent the fuze well 116. Mounting the sensor 238 in the flange 236, which is securely attached to the fuze well 116, which is in turn welded to the warhead case 114, reduces the number of noise-generating or—amplifying mechanical joints between the sensor 238 and the warhead 110. This more closely mechanically couples the sensor 238 to the warhead 110, reduces high frequency shock amplification, and increases system sensitivity.

The sensor 238 may be secured in any appropriate manner to the weapon 100. For example, the flange 236 may include a threaded cavity to receive a threaded sensor 238 connection. The sensor 238 may be disposed fully or partially within the flange 236, or may be mounted on the exterior of the flange 236. In other embodiments, the sensor 238 may be located elsewhere, such as on or in a portion of the fuze housing 216, the fuze well 116, or the warhead case 114. Further, the sensor 238 may be mounted using vibration isolation materials to isolate the sensor 238 from vibrations within the fuze housing 216 and fuze housing flange 236. For example, the sensor 238 may be mounted on a rubber and/or potting material or other suitable shock-dampening material.

The booster 214 comprises a mechanism for detonating the warhead 110, such as an explosive, and responds to the fuze 212. In some embodiments, the fuze 212 may be sufficient to detonate the warhead 110 without the need for a booster 214, in which case the booster 214 may be omitted. The booster 214 may comprise any appropriate mechanism and/or material for detonating the warhead 110, such as a conventional booster. In the present embodiment, the booster 214 comprises a conventional booster comprising an explosive contained within a housing 240.

The booster 214 is mounted on the weapon 100 and is responsive to the fuze 212. The booster 214 may be mounted on the weapon 100 in any appropriate manner and any suitable portion of the weapon 100, such as the on the warhead case 114 or the fuze 212. In the present embodiment, the booster housing 240 is attached to the fuze well 116 adjacent the end of the fuze 212. The booster 214 is sufficiently proximate to the fuze 212 to ensure that the booster 214 responds to the fuze 212, for example by exploding in response to the activation of the fuze 212. By attaching the booster 214 to the fuze well 116 instead of the fuze 212, the length of the fuze 212 may be shorter, which reduces lateral forces that tend to deflect the fuze 212 and cause the fuze housing 216 to strike the fuze well 116, generating undesirable vibrations.

The booster housing 240 may be permanently attached or removably attached to the fuze well 116, such as via a threaded connection, removable fasteners 234, and the like. The booster housing 240 may be mounted in any appropriate manner, however, such as using conventional fasteners 234, welds, adhesives, integral formation into the fuze well 116, and the like.

The booster housing 240 may comprise any suitable structure for housing the booster explosive portion of the fuze system 112. For example, the booster housing 240 may comprise a metal housing into which the booster explosive is installed. The booster housing 240 may be constructed from any suitable material such as steel, hardened steel, ceramics, composites, or other appropriate material. The booster explosive may comprise any explosive material capable of detonating the warhead 110 in response to a suitable signal or impulse.

In operation, the weapon 100 is assembled separately from the fuze 212. The fuze well 116 may be rigidly and permanently attached to the warhead case 114, such as via welding, molding, machining, or the like to eliminate a potentially moving joint between the warhead case 114 and the fuze well 116. The sensor 238 may be installed in position, such as on the flange 236, at the time the warhead 110 and fuze well 116 are assembled, or may be connected to the fuze 212 and then installed on the weapon 100 when the fuze 212 is connected to the fuze well 116. In the present embodiment, the sensor 238 is installed in its position on the flange 236 shortly after the fuze well 116 is welded to the warhead case 114. Separately, the fuze 212 is fabricated and prepared, and the fuze 212 and the warhead 110 are maintained separately until the weapon 100 is prepare for deployment.

To prepare the weapon 100 for deployment, the fuze system 112 is connected to the rest of the weapon 100. In particular, the booster 214 may be installed, for example by screwing the threaded exterior of the booster housing 240 into the threaded interior of the fuze well 116. The fuze housing 216 may then be inserted into the fuze well 116 and secured by bolts through the flange 236. The sensor 238 may also be connected to the control system 232, such as via the electrical connector, a hard-wire connection integrated into the fuze housing 216 and/or the flange 236, or other suitable connection. In addition, the control system 232 may be programmed with desired operating parameters and/or target discrimination data, such as data describing the desired penetration of a target before detonation.

The weapon 100 may then be deployed towards the target. The sensor 238 detects relevant information and transmits corresponding signals to the control system 232. For example, when the weapon 100 strikes the target, the sensor 238 may send a signal to the control system 232 corresponding to the deceleration. As the weapon 100 penetrates multiple levels and encounters incremental decelerating events at each level, the sensor 238 provides corresponding signals to the control system 232.

The sensor 238 may provide improved sensitivity and data to the control system 232. For example, because the fuze well 116 may be welded or otherwise secured to the warhead case 114. The mechanical joint between the fuze well 116 and the warhead case 114 may be eliminated, thus eliminating a source of vibrations and/or shock amplification that may disrupt the operation of the sensor 238. Further, with the booster 214 detached from the fuze 212, the fuze 212 is shorter and lighter, creating less force on the fuze 212 and reducing the likelihood of the fuze 212 deflecting laterally and contacting the fuze well 116, thus avoiding further unwanted vibrations.

In addition, securing the fuze 212 to the fuze well 116 via multiple connectors and/or the flange 236, instead of the typical single threaded connection, facilitates greater preloading of the connector and more even distribution of the preload force, further reducing vibrations and amplification. Moreover, mounting the sensor 238 with fewer mechanical joints between the sensor 238 and the warhead 110, such as on the flange 236, provides more accurate coupling between the warhead 110 and the sensor 238.

The control system 232 may process the data from the sensor 238, for example to determine whether the programmed target discrimination criteria have been fulfilled. For example, if the weapon 100 was programmed to detonate on the third level of a bunker, the control system 232 may count the incremental significant decelerations indicated by the sensor 238 corresponding to striking significant structural obstacles. Upon penetrating through the third obstacle (i.e., the ceiling of the third level), the control system 232 may initiate detonation.

The fuze 212 may initiate detonation in any appropriate manner. In the present embodiment, the control system 232 provides an electrical signal to the fuze's detonating element 230, causing the detonating element 230 to explode. The energy of the detonating element's explosion causes the booster 214 to explode, which generates energy to detonate the warhead 110 and destroy the target according to the target discrimination parameters.

In the foregoing specification, the invention has been described with reference to specific exemplary embodiments. Various modifications and changes may be made without departing from the scope of the present invention as set forth in the claims below. The specification and figures are to be regarded in an illustrative manner, rather than a restrictive one. Accordingly, the scope of the invention should be determined by the claims and their legal equivalents rather than by merely the examples described above.

For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited.

Benefits, other advantages and solutions to problems have been described above with regard to particular embodiments. Any benefit, advantage, solution to a problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles.

The invention claimed is:

1. A weapon, comprising:
a warhead case;
a fuze well rigidly and permanently secured to the warhead case, the fuze well including a circumferential groove formed within an interior surface of the fuze well;
a fuze system having a proximal end and a distal end, the fuze system comprising:
a fuze housing including a flange at the proximal end; and
multiple fasteners securing the flange to the fuze well;
a seal component seated within the circumferential groove between the interior surface of the fuze well and an exterior surface of the fuze housing; and
at least one anti-vibration mount provided between the fuze well and the fuze system at the distal end of the fuze system.

2. A weapon according to claim 1, further comprising a sensor disposed on the flange.

3. A weapon according to claim 2, wherein the sensor comprises an accelerometer.

4. A weapon according to claim 1, wherein the fuze system further comprises a booster attached to the fuze well and disposed adjacent the fuze housing.

5. A weapon according to claim 1, wherein the fuze well:
is welded to the warhead case; and
defines a vent therethrough.

6. A weapon according to claim 1, wherein the flange comprises a circular flange extending around an end of the fuze housing.

7. A weapon according to claim 1, wherein the flange defines a plurality of holes therethrough, wherein:
each hole has a corresponding longitudinal axis;
the longitudinal axes of the holes are parallel to a longitudinal axis of the weapon; and
the holes are approximately evenly distributed around the longitudinal axis of the weapon.

8. A weapon according to claim 7, further comprising a plurality of fasteners disposed through the holes in the flange, wherein the plurality of fasteners are configured to engage the fuze well.

9. A fuze system for connecting to a weapon having a fuze well, comprising:
a fuze housing configured to be inserted into the fuze well of the weapon; and
a connector attached to an end of the fuze housing, wherein:
the connector includes multiple connection points configured to be secured to the fuze well of the weapon; and
the multiple connection points are approximately evenly distributed around a longitudinal axis of the weapon;
a seal component provided between an interior surface of the fuze well and an exterior surface of the fuze housing; and
at least one anti-vibration mount provided between the fuze well and the fuze housing.

10. A fuze system according to claim 9, wherein the connector comprises a flange extending from the end of the fuze housing.

11. A fuze system according to claim 10, wherein the flange defines a plurality of holes therethrough, wherein:
each hole is defined along a corresponding longitudinal axis of the hole;
the longitudinal axes of the holes are parallel to a longitudinal axis of the weapon; and
the holes are approximately evenly distributed around the longitudinal axis of the weapon.

12. A fuze system according to claim 11, further comprising a plurality of fasteners disposed through the holes in the flange, wherein the plurality of fasteners are configured to engage the weapon.

13. A fuze system according to claim 10, further comprising a sensor disposed on the flange.

14. A fuze system according to claim 13, wherein the sensor comprises an accelerometer.

15. A fuze system according to claim 9, further comprising a booster attached to the weapon and disposed adjacent the housing.

16. A fuze system for connecting to a fuze well of a weapon, comprising:
a fuze housing, comprising:
a wall, wherein an interior surface of the wall defines an interior cavity;
a circular flange attached to the wall near an end of the fuze housing, wherein the circular flange defines a plurality of holes therethrough, wherein:
the holes are defined along a longitudinal axis;
the longitudinal axes of the holes are parallel to a longitudinal axis of the weapon; and
the holes are approximately evenly distributed around the longitudinal axis of the weapon
a plurality of fasteners disposed through the holes in the flange, wherein the plurality of fasteners are configured to engage the fuze well;
a seal component seated within a circumferential groove between the fuze well and the fuze housing;
at least one anti-vibration mount provided between the fuze well and the fuze system;
a control system disposed within the interior cavity;
a detonating element disposed within the interior cavity and responsive to the control system;
an accelerometer mounted on the flange and coupled to the control system, wherein the control system is configured to detonate the detonating element according to at least one signal from the sensor.

17. A fuze system according to claim 16, further comprising a booster, comprising:
a booster housing configured to be attached to the fuze well adjacent the detonating element; and
a booster explosive disposed within the booster housing.

18. A fuze system according to claim 17, wherein the booster housing comprises a threaded exterior surface configured to engage a threaded surface of the fuze well.

19. A fuze system according to claim 16, wherein the accelerometer is mounted on the flange proximate a point of contact between the flange and the fuze well.

20. A fuze system according to claim 16, wherein an exterior surface of the wall is tapered and configured to engage a tapered interior surface of the fuze well.

* * * * *